US005578909A

United States Patent [19]

Billen

[11] Patent Number: 5,578,909

[45] Date of Patent: Nov. 26, 1996

[54] COUPLED-CAVITY DRIFT-TUBE LINAC

[75] Inventor: James H. Billen, Los Alamos, N.M.

[73] Assignee: The Regents of the Univ. of California, Alameda, Calif.

[21] Appl. No.: 275,865

[22] Filed: Jul. 15, 1994

[51] Int. Cl.[6] ..... H05H 9/00; H05H 7/00

[52] U.S. Cl. ..... 315/505; 315/500

[58] Field of Search ..... 315/500, 505, 315/5.41, 5.42, 5.46, 5.47

[56] References Cited

U.S. PATENT DOCUMENTS

| | | | |
|---|---|---|---|
| 5,021,741 | 6/1991 | Kornely, Jr. et al. | 315/505 |
| 5,179,350 | 1/1993 | Bower et al. | 315/505 |

OTHER PUBLICATIONS

A. V. Mishin, "Accelerator Structure for Low–Energy Electron Beam", IEEE PAC 93 Proceedings, pp. 971–973, 1993.

*Primary Examiner*—Nimeshkumar D. Patel

*Attorney, Agent, or Firm*—Ray G. Wilson

[57] ABSTRACT

A coupled-cavity drift-tube linac (CCDTL) combines features of the Alvarez drift-tube linac (DTL) and the $\pi$-mode coupled-cavity linac (CCL). In one embodiment, each accelerating cavity is a two-cell, 0-mode DTL. The center-to-center distance between accelerating gaps is $\beta\lambda$, where $\lambda$ is the free-space wavelength of the resonant mode. Adjacent accelerating cavities have oppositely directed electric fields, alternating in phase by 180 degrees. The chain of cavities operates in a $\pi/2$ structure mode so the coupling cavities are nominally unexcited. The CCDTL configuration provides an rf structure with high shunt impedance for intermediate velocity charged particles, i.e., particles with energies in the 20–200 MeV range.

11 Claims, 5 Drawing Sheets

COUPLED-CAVITY DRIFT-TUBE LINAC

This invention relates to accelerators for charged particles, and, more particularly, to drift-tube and coupled cavity linear accelerators (linac). This invention was made with government support under Contract No. W-7405-ENG-36 awarded by the U.S. Department of Energy. The government has certain rights in the invention.

BACKGROUND OF THE INVENTION

There are many research, medical, and military applications for intermediate velocity charged particles, i.e., particles with velocities corresponding to proton energies in the 20–200 MeV range. One particular example is a proton beam for cancer therapy. At present, one conventional technique for accelerating charged particles to the desired energy range is to take the output from a 45 MeV proton beam from a cyclotron and input the beam to a synchrotron for acceleration above 100 MeV. Synchrotrons are relatively complex and expensive machines, however, and it would be desirable to use simpler linear accelerators.

Coupled-cavity and drift-tube linear accelerators are not equally efficient for accelerating particles over an entire energy range of about 20 MeV to 200 MeV. Traditionally, a drift-tube linac (DTL) is the structure of choice for low velocity charged particles in the velocity range around $\beta=0.2$ (which corresponds to a 20 MeV proton), where $\beta$ conventionally represents the ratio of the particle velocity to the speed of light. In this velocity range, the DTL is more efficient than $\pi$-mode structures, such as a coupled-cavity linac (CCL), where efficiency is characterized by the effective shunt impedance per unit length (Mohm/m).

But a DTL is a very difficult device to properly tune unless the drift tubes are tightly coupled, i.e., a small number of drift tubes are used. Further, at higher particle velocities, the DTL drops in efficiency because the drift tubes must become longer as particle velocity increases. In addition, DTLs ordinarily require post couplers, i.e., resonant stabilizing devices, to enhance overall beam stability. Post couplers are difficult to model with computer simulations and design optimization generally requires operating prototypes or adjustable hardware that can be optimized in place.

At these low and intermediate velocities, a CCL requires a large number of accelerating cavities, each with a relatively large ratio of cavity surface area to cavity volume, with a concomitant low effective shunt impedance per unit length and low efficiency. At velocities above about $\beta=0.42$ (100 MeV proton), the CCL becomes more efficient than the 0-mode DTL. But neither the DTL nor the CCL is efficient over the energy range of 20–200 MeV.

The present invention addresses this problem and combines features of the DTL and CCL to provide a linac over the energy range of 20–200 MeV. Accordingly, it is an object of the present invention to efficiently accelerate charged particles over an intermediate velocity range of 20–200 MeV.

It is another object of this invention to provide a linac with a relatively high shunt impedance per unit length for accelerating intermediate velocity charged particles.

One other object of the present invention is to provide a linac where it is relatively easy to balance the power distribution along the accelerator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a linear accelerator for accelerating charged particles through an intermediate velocity range. The accelerator includes a plurality of accelerating cavities, where each one of the accelerating cavities defines input and output coaxial bore tubes connecting adjacent ones of the accelerating cavities. Each accelerating cavity encloses n drift tubes that are intermediate and coaxial with the input and output bore tubes. The n drift tubes define n+1 accelerating gaps between the input and output bore tubes.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
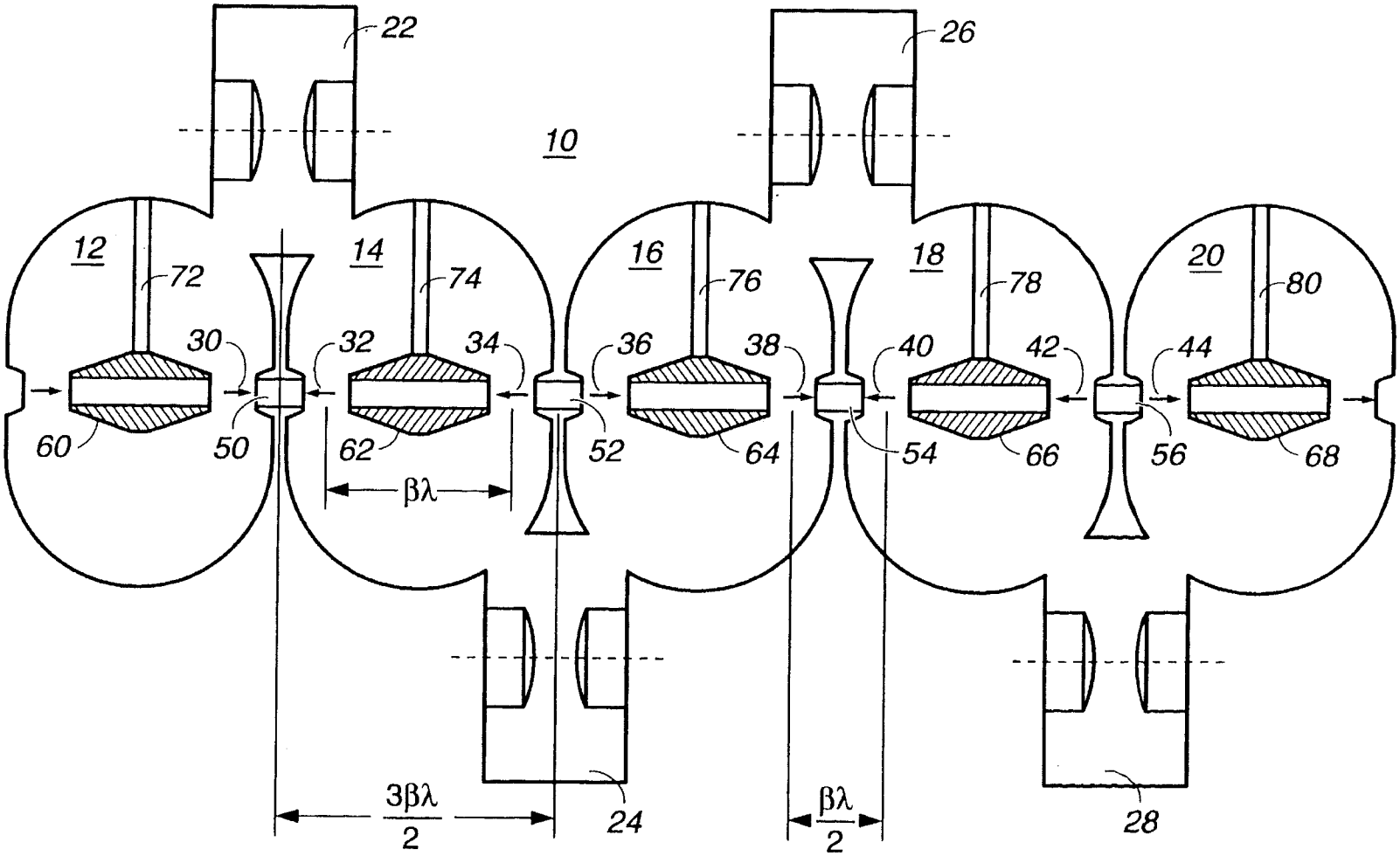
FIG. 1 is a pictorial illustration in cross-section of one embodiment of a coupled-cavity drift-tube linac (CCDTL) according to the present invention.
Figure 2:
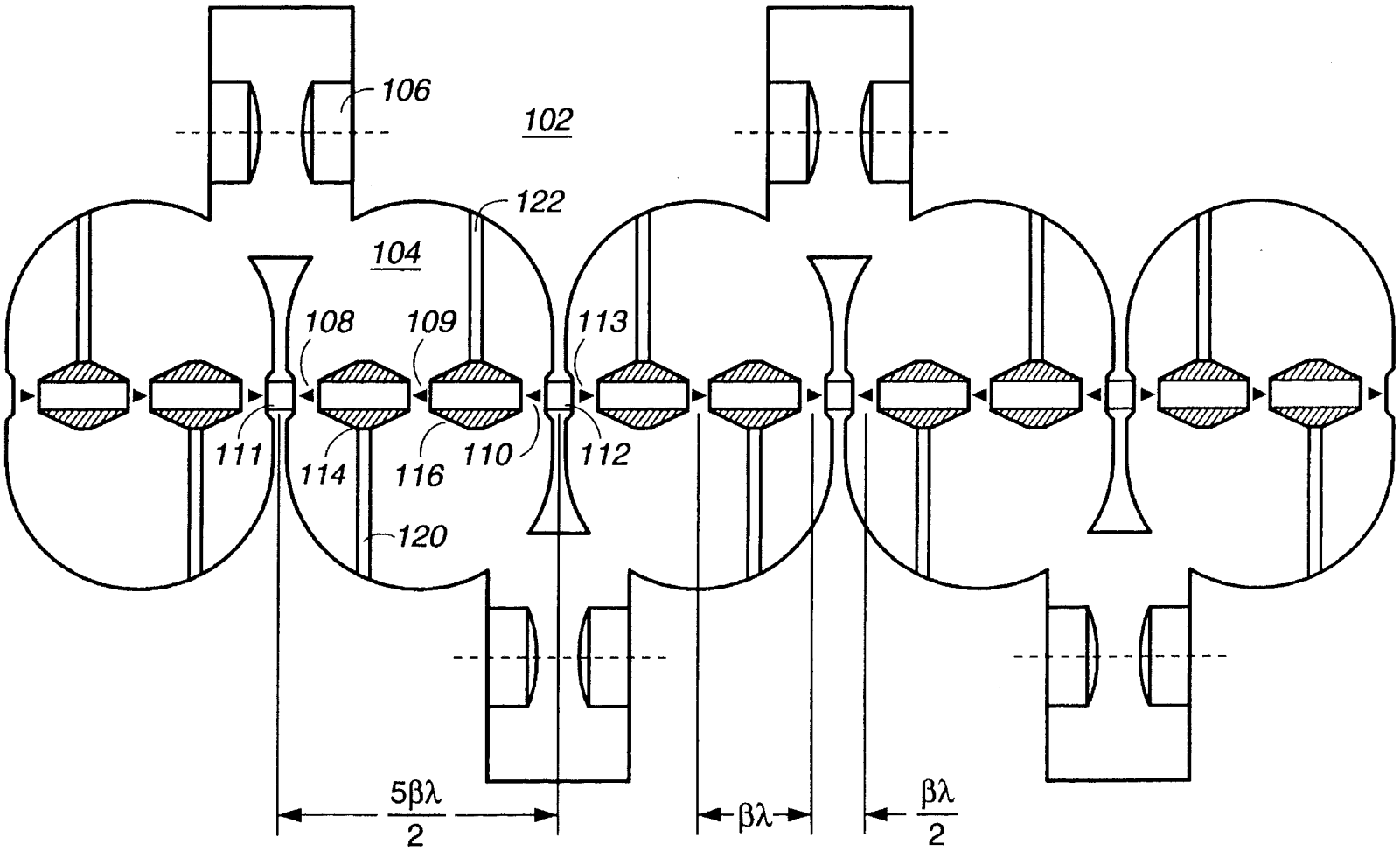
FIG. 2 is a pictorial illustration in cross-section of another embodiment of a CCDTL linac according to the present invention.

In accordance with the present invention, features of a CCL and a DTL are combined to form a CCDTL, where drift tube structures are included within a CCL accelerating cavity for accelerating intermediate-velocity charged particles. The resulting structure has a high shunt impedance for efficient operation in a particle velocity range of $0.2 \leqq \beta \leqq 0.5$. FIGS. 1 and 2 are cross-sectional illustrations of CCDTL linacs in accordance with the present invention.

Referring first to FIG. 1, a single drift tube linac is illustrated. Accelerator structure 10 defines a plurality of accelerating cavities 12, 14, 16, 18, 20 that define accelerating electric fields from radio frequency (rf) energy input in a conventional manner. A charged particle beam, e.g., protons, is formed and accelerated along a beam axis by an initial accelerator, such as a radio frequency quadrupole or a cyclotron, to a velocity that is suitable for input to a DTL linac. The electromagnetic fields in adjacent cavities are coupled by coupling cavities 22, 24, 26, 28 so that the chain of accelerating cavities operates in a $\pi/2$ structure mode and the coupling cavities are nominally unexcited. As is well known, coupling cavities 22, 24, 26, 28 couple energy between adjacent accelerating cavities if an energy imbalance arises. A $\pi/2$ mode linac forms a stable accelerating structure. While FIG. 1 shows a side-coupled structure, on-axis coupling or other coupling arrangement commonly applied to conventional CCLs may be used.

For purposes of this description, a beam of charged particles is accelerated in a direction from cavity 12 to cavity 20 along a beam axis, where the beam axis forms the axis for the accelerator structures hereinafter discussed. Adjacent ones of accelerating cavities 12, 14, 16, 18, 20 are connected by coaxial bore tubes 50, 52, 54, 56 so that each accelerating cavity has an input and an output bore tube that are coaxial with the particle beam axis, e.g., accelerating cavity 16 has an input bore tube 52 and an output bore tube 54. The designations "input" and "output" are relative to the direction for accelerating the charged particle beam.

Within each accelerating cavity 12, 14, 16, 18, 20 is a drift tube 60, 62, 64, 66, 68 that is supported by a support stem 72, 74, 76, 78, 80, respectively. FIG. 1 illustrates a single support stem, but two stems might be used to facilitate cooling. Also, the orientation of the stems is away from the plane of the coupling cavities in order to minimize electromagnetic field asymmetries near the slots that couple each accelerating cavity into its associate coupling cavity.

In accordance with the present invention, the accelerating cavity structure and the drift tube structure defines accelerating field gaps 30, 32, 34, 36, 38, 40, 42, 44 that are appropriately spaced for accelerating charged particles in phase with the applied rf energy. Within each accelerating cavity, the drift tube operates in a "zero mode," i.e., the accelerating field within the gaps on either side of a drift tube have the same orientation, as shown by the arrows in FIG. 1. The center-to-center spacing of the gaps within an accelerating cavity, e.g., accelerating gaps 32 and 34 within accelerating cavity 14, is $\beta\lambda$, where $\beta$ is the relative particle velocity and $\lambda$ is the free-space wavelength of the resonant mode within the accelerating cavity. Adjacent accelerating cavities e.g., cavities 12 and 14, have oppositely directed electric fields, alternating in phase by 180 degrees or $\pi$ radians. The chain of accelerating cavities 12, 14, 16, 18, 20 operates in a $\pi/2$ structure mode so that the coupling cavities 22, 24, 26, 28 are nominally unexcited. The center-to-center spacing of successive accelerating gaps in adjacent accelerating cavities, e.g., gap 30 in accelerating cavity 12 and gap 32 in accelerating cavity 14, is $\beta\lambda/2$. For a single drift tube structure, the total length of each accelerating cavity is $3\beta\lambda/2$. As used herein, the length of an accelerating cavity is the center-to-center distance between bore tubes. This arrangement ensures that a particle always encounters an accelerating field in every gap.

The CCDTL structure shown in FIG. 1 has a better effective shunt impedance than either DTL or CCL structures over a wide range of $\beta$. The CCDTL competes favorably with the DTL at low $\beta$, as discussed below, if more than one drift tube per accelerating cavity is used. A CCDTL structure with two drift tubes per accelerating cavity is shown in FIG. 2. Only one accelerating cavity and associated structure has been labeled since identical functional structures are provided in successive accelerating cavities, as in FIG. 1. Thus, accelerator structure 102 defines accelerating cavity 104 and bore tubes 111 and 112 at each end of accelerating cavity 104. Drift tubes 114 and 116, supported by stems 120 and 122, respectively, are coaxial with bore tubes 111, 112 and spaced within accelerating cavity 104 to define accelerating gaps 108, 109, 110 having a center-to-center spacing of $\beta\lambda$, and accelerating gaps on either side of a bore tube, e.g., gaps 110 and 113 on either side of bore tube 112, have a center-to-center spacing of $\beta\lambda/2$. The total length of accelerating cavity 104 is now $5\beta\lambda/2$.

It will be understood that it may be advantageous in some applications to include additional drift tubes within an accelerating cavity. If n drift tubes are incorporated then the length of the accelerating cavity becomes $(2n+1)\beta\lambda/2$. There are (n+1) accelerating gaps within the accelerating cavity, with the accelerating gaps having a center-to-center spacing of $\beta\lambda$. The center-to-center spacing of successive accelerating gaps in adjacent ones of the accelerating cavities remains $\beta\lambda/2$. In general, it is expected that only a small n, e.g., n=1 or 2, would be selected.

Figure 3:
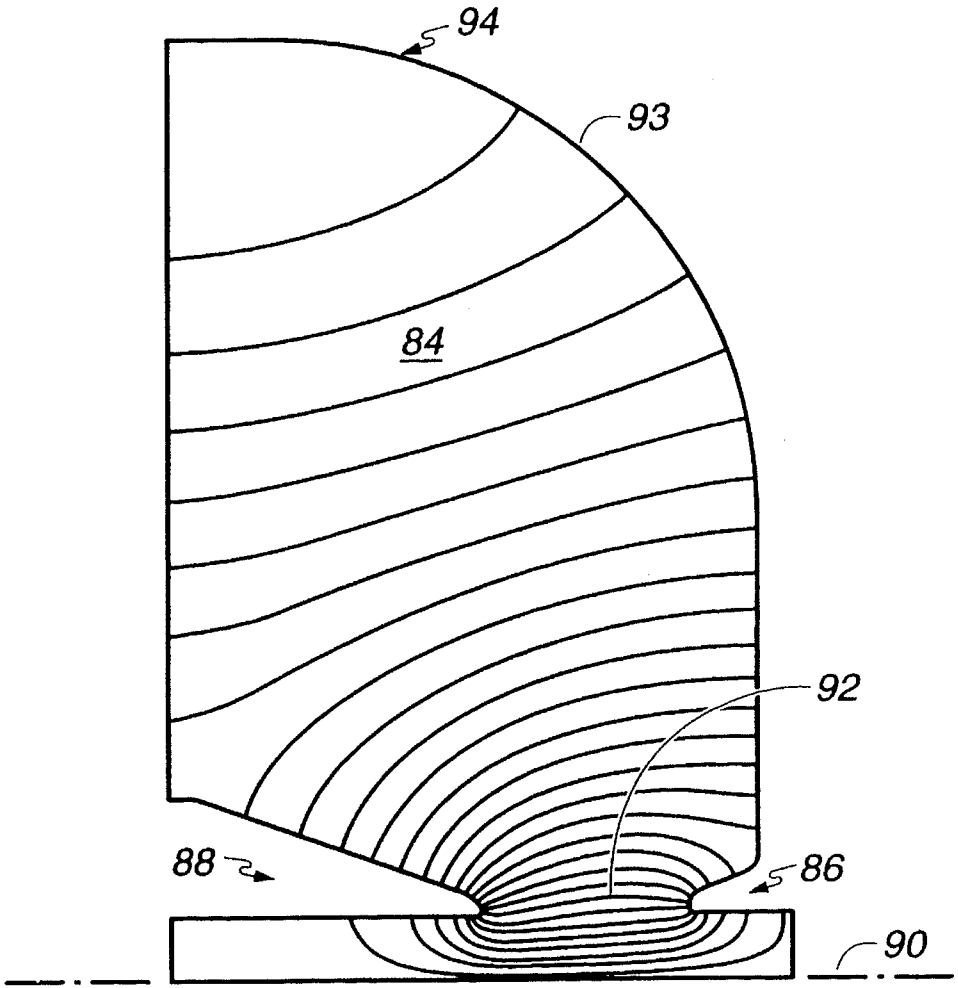
FIG. 3 is a cross-section of a CCDTL half cavity showing electric field lines within the cavity.

FIG. 3 schematically illustrates the electric field lines within a half accelerating cavity 84 that is symmetric about particle beam axis 90 as plotted by SUPERFISH software, available from Los Alamos National Laboratory, for the configuration shown in FIG. 1. The shape of the cavity wall can now be similar to that of an accelerating cavity for use at a higher $\beta$, i.e., a reduced ratio of accelerating cavity surface area to cavity volume. The cavity wall 93 has a large radius along the upper surface 94 to provide this improved ratio. The gap 92 between the bore tube nose 86 and drift tube nose 88 is approximately $\beta\lambda/4$, resulting in a reasonably large transit-time factor for particle acceleration. As shown in FIG. 3, drift-tube nose 88 is sharp, i.e., a smaller radius of curvature, relative to conventional drift-tubes and forms a low capacitance with the bore tube nose 86 for a low total power requirement. The shape of drift-tube nose 88 is optimized using SUPERFISH to balance power density (low for cooling) with shunt impedance (large for high efficiency).

Figure 4:
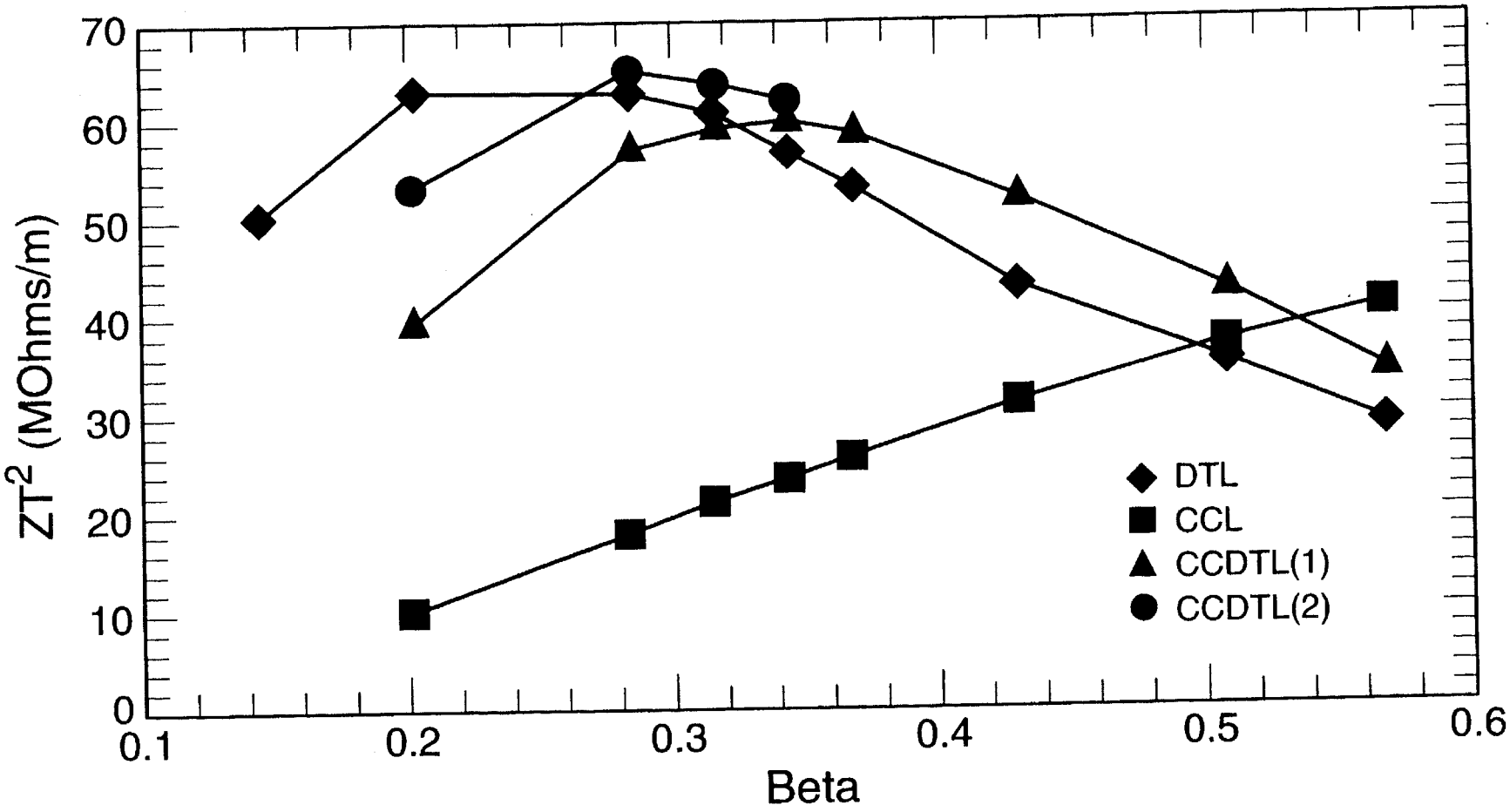
FIG. 4 graphically compares shunt resistance per unit length corrected for power losses in designated linac configurations.

FIG. 4 graphically compares the calculated effective shunt impedance per unit length, conventionally designated by $ZT^2$, for a DTL, CCL, and CCDTL configurations shown in FIGS. 1 and 2. For this comparison, each of the linac structures was tuned to 700 MHz, the same bore tube shape and radius was used, and the same drift tube configuration was used. The CCDTL structure has a better shunt impedance than either the DTL or CCL structures over a wide range of $\beta$. It compares favorably with the DTL at low $\beta$ if more than one drift tube per accelerating cavity is used, as shown in FIG. 2. Even a one-drift-tube linac at $\beta$=0.2 (20 MeV protons) has a higher $ZT^2$ than a conventional CCL has at a $\beta$=0.42 (100 MeV protons).

With respect to a CCL, the CCDTL has less wall structure than a CCL; e.g., the embodiment shown in FIG. 1 has one third the number of cavities per unit length as a CCL at the same $\beta$. This reduces the amount of wall structure in which power losses occur and reduces the number of coupling cavities with their associated power losses (about 3% for each percent of coupling). The DTL structure within an accelerating cavity is short so that additional stabilizing structure, such as post couplers, is not required for stability as would be necessary in a conventional DTL. Indeed, longitudinal beam stability should not be a problem in a CCDTL because it operates in a $\pi/2$ structure mode. The individual accelerating cavities are short so the higher order TM modes are far above the $TM_{010}$ operating mode frequency.

Figure 5:
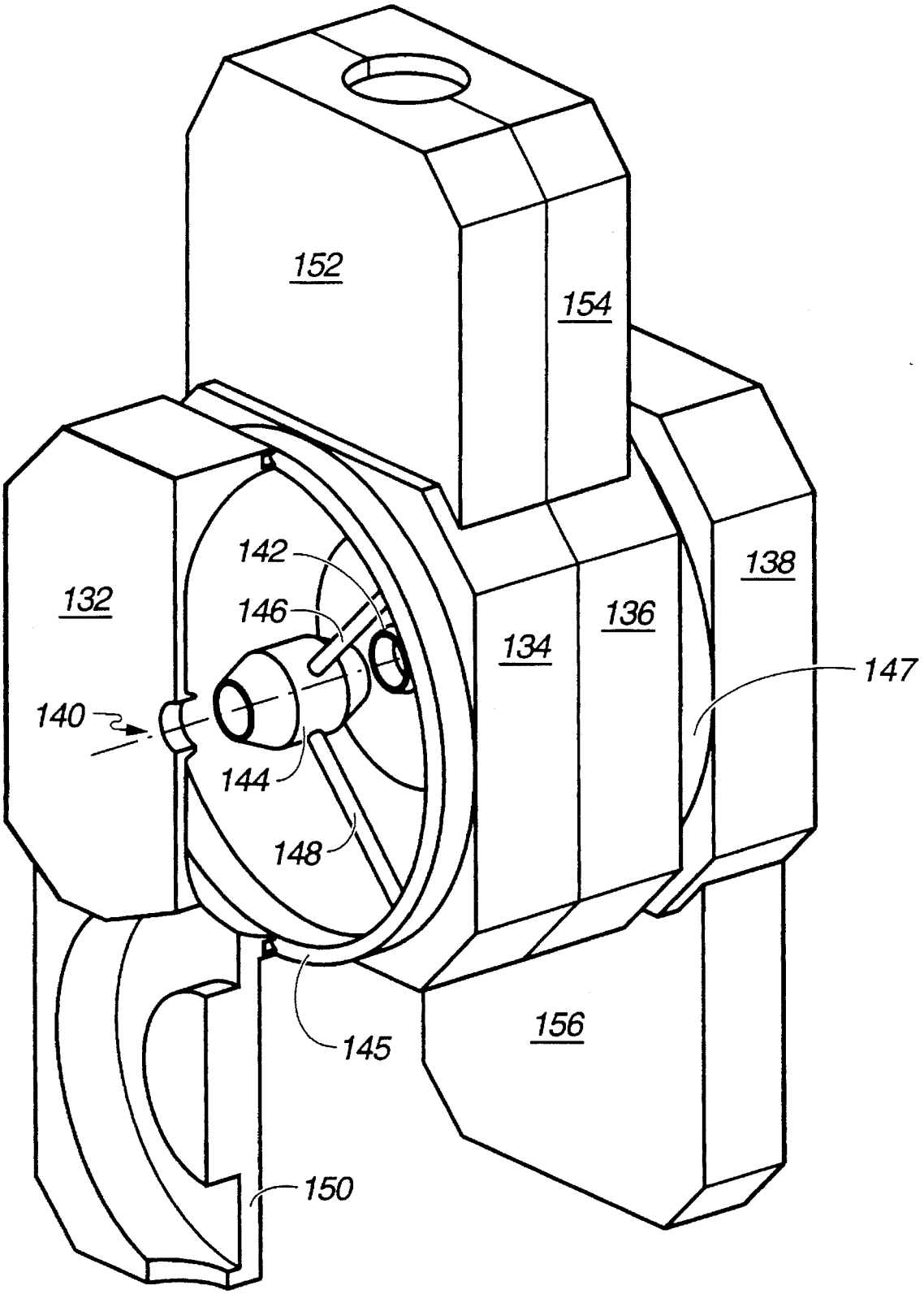
FIG. 5 is an isometric view in partial cut-away of CCDTL structure according to one embodiment of the present invention.

Referring now to FIG. 5, there is shown an isometric view, in partial cutaway, of CCDTL structure according to the embodiment shown in FIG. 1. Each accelerating cavity is formed from two half cavity structures 132, 134, 136, 138, each of which incorporates half a bore tube, e.g., half cavity 132 defines half bore tube 140 and half cavity 134 defines half bore tube 142. Each half cavity structure 132, 134, 136,

138 has an attached half coupling cavity 150, 152, 154, 156, respectively, as discussed above. Drift tube 144 is supported from support ring 145 by two support stems 146, 148, whose alignment is selected to provide minimum field asymmetries in an assembled CCDTL cell structure. Half field cavities 132, 134, coupling cavities 150, 152, support ring 145 with attached drift tube 144 form one cell; half field cavities 136, 138, coupling cavities 154, 156, support ring 147 with its attached drift tube (not shown) form a second cell. In a preferred assembly, the structural components are formed of copper and the assembly is brazed together to eliminate power losses from joints.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A linear accelerator (linac) for accelerating charged particles with radio frequency (rf) energy through an intermediate velocity range, said accelerator comprising:

a plurality of accelerating cavities, each one of said accelerating cavities defining input and output coaxial bore tubes connecting adjacent ones of said accelerating cavities; and a number of drift tubes, n, within each of said accelerating cavities located intermediate and coaxial with said input and output bore tubes, said n drift tubes defining n+1 accelerating gaps between said input and output bore tubes, wherein the center-to-center spacing between successive ones of said accelerating gaps in said accelerating cavity is the distance a particle travels in one period of said rf.

2. A linac according to claim 1, wherein each said accelerating cavity has a length of (2n+1)/2 times the distance a particle travels in one period of said rf.

3. A linac according to claim 1 or claim 2, wherein successive ones of said accelerating gaps in adjacent ones of said accelerating cavities have a center-to-center spacing defined by one-half the distance a particle travels in one period of said rf.

4. A linear accelerator (linac) for accelerating charged particles through an intermediate velocity range, said accelerator comprising:

a plurality of resonantly coupled accelerating cavities coupled with nominally unexcited coupling cavities to form a $\pi/2$ mode linac accelerating structure, each one of said accelerating cavities defining input and output coaxial bore tubes connecting adjacent ones of said accelerating cavities; and a number of drift tubes n within each of said accelerating cavities located intermediate and coaxial with said input and output bore tubes, said n drift tubes defining n+1 accelerating gaps between said input and output bore tubes.

5. A linac according to claim 4, wherein each said accelerating cavity has a length of (2n+1)/2 times the distance a particle travels in one period of said rf.

6. A linac according to claim 4, wherein have a center-to-center spacing defined by successive ones of said accelerating gaps in said accelerating cavity the distance a particle travels in one period of said rf.

7. A linac according to claim 6, wherein each said accelerating cavity has a length of (2n+1)/2 times the distance a particle travels in one period of said rf.

8. A linac according to any one of claims 4 through 7 wherein successive ones of said accelerating gaps in adjacent ones of said accelerating cavities is have a center-to-center spacing defined by one-half the distance a particle travels in one period of said rf.

9. A linear accelerator (linac) for accelerating charged particles through an intermediate velocity range, said accelerator comprising:

a plurality of accelerating cavities, each one of said accelerating cavities defining input and output coaxial bore tubes connecting adjacent ones of said accelerating cavities; and a number of drift tubes n within each of said accelerating cavities located intermediate and coaxial with said input and output bore tubes, said n drift tubes defining n+1 accelerating gaps between said input and output bore tubes;

wherein each said accelerating cavity has a length of (2n+1)/2 times the distance a particle travels in one period of said rf.

10. A linac according to claim 9, wherein successive ones of said accelerating gaps in said accelerating cavity have a center-to-center spacing defined by the distance a particle travels in one period of said rf.

11. A linac according to claim 9 or claim 10, wherein successive ones of said accelerating gaps in adjacent ones of said accelerating cavities is have a center-to-center spacing defined by one-half times the distance a particle travels in one period of said rf.

* * * * *